United States Patent [19]

Stauter

[11] 4,124,461

[45] Nov. 7, 1978

[54] PRODUCTION OF METALLIC LEAD

[75] Inventor: John C. Stauter, Streamwood, Ill.

[73] Assignee: UOP Inc., Des Plaines, Ill.

[21] Appl. No.: 883,114

[22] Filed: Mar. 3, 1978

[51] Int. Cl.[2] ..... C25C 1/18

[52] U.S. Cl. ..... 204/117; 204/114

[58] Field of Search ..... 204/114, 117; 75/120, 75/114

[56] References Cited

U.S. PATENT DOCUMENTS

| | | | |
|---|---|---|---|
| 2,664,393 | 12/1953 | Mathers et al. | 204/114 |
| 2,827,410 | 3/1958 | Smyers et al. | 204/114 |

*Primary Examiner*—R. L. Andrews

*Attorney, Agent, or Firm*—James R. Hoatson, Jr.; Raymond H. Nelson; William H. Page, II

[57] ABSTRACT

Metallic lead may be obtained from lead bearing sources such as lead sulfide ores or concentrates by halogenating the lead source, brine leaching the lead halide to separate the soluble lead halide from solid material such as gangue and recrystallizing the lead halide at a reduced temperature. Following this the lead halide is then converted to lead carbonate by treating the lead chloride with sodium bicarbonate. Thereafter the lead compounds are solubilized in hydrofluosilicic acid and subjected to electrowinning to produce lead sheet on the cathode.

9 Claims, 1 Drawing Figure

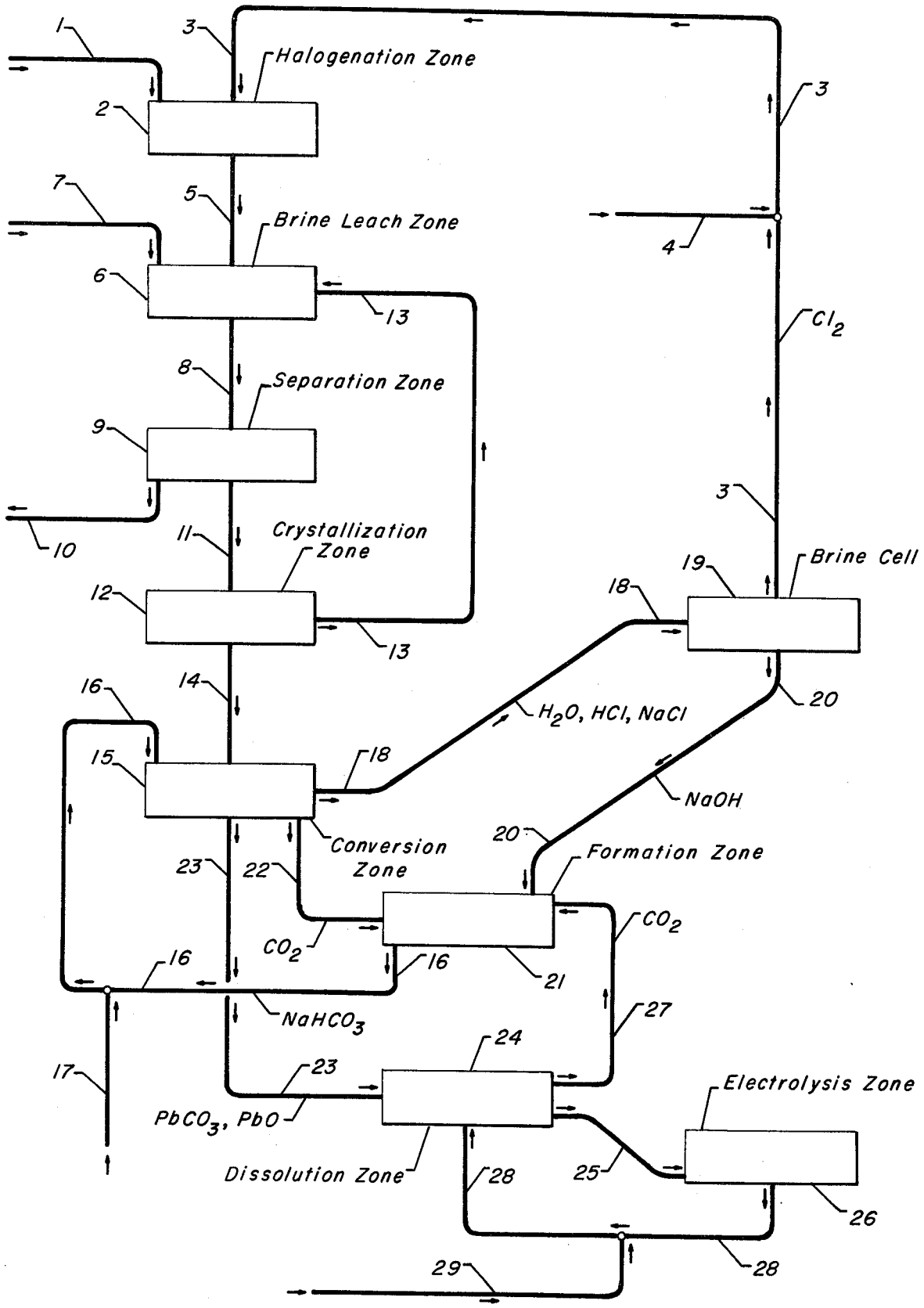
Halogenation Zone
Brine Leach Zone
Separation Zone
Crystallization Zone
Brine Cell
$H_2O$, HCl, NaCl
NaOH
Conversion Zone
Formation Zone
$CO_2$
$NaHCO_3$
$PbCO_3$, PbO
Dissolution Zone
Electrolysis Zone
$Cl_2$

PRODUCTION OF METALLIC LEAD

BACKGROUND OF THE INVENTION

In standard methods of obtaining metallic lead from concentrates, the standard procedure has been to treat the lead sulfide concentrates in a blast furnace. However, the pyrometallurgical procedure possesses many disadvantages and drawbacks. Primary among these disadvantages is that the process will result in some major pollution problems such as the generation of sulfur oxide gas along with substantial fuming. The fuming carries with it possible carcinogenic compounds which will contain lead, cadmium, etc. Therefore, it is necessary to provide improved and safer methods for obtaining metals such as lead in metallic or elemental form by methods which will not contribute to pollution of the air or will be safer to operate. The aforementioned lead smelting techniques will consist of roast sintering the lead sulfide concentrate whereby a major portion of the sulfur will be removed followed by melting in a blast furnace to obtain the metallic lead.

In an effort to alleviate the pollution problem, it is necessary to develop new processes for obtaining lead which will be competitive as an alternative to the conventional smelting practices. Prior work in the hydrometallurgical field resulted in developing a non-aqueous processing route whereby lead sulfide concentrates are chlorinated at temperatures above 300° C. to produce lead chloride and volatilized sulfur. However, chlorination at these elevated temperatures will promote the formation of volatile chlorides of contaminating elements such as iron, magnesium, aluminum, silicon, zinc, as well as elemental sulfur which may be present in the lead sulfide concentrate. Other hydrometallurgical processes which have been developed include the use of ferric sulfate as a leach agent. In this method, the lead sulfide is sulfated to form lead sulfate. This step is then followed by carbonation of the lead sulfate to form lead carbonate and thereafter the lead carbonate is subjected to dissolution in hydrofluorsilicic acid for electrolysis to metallic lead. Yet another hydrometallurgical method which is developed for the recovery of lead is based on the use of a ferric chloride medium. This method involves a leaching step whereby the lead sulfide is converted to lead chloride and thereafter subjected to steps of solubilizing, crystallization and electrolysis.

The prior art which exemplifies some methods of recovering lead or other metals is exemplified by United States Ser. No. 607,287 now U.S. Pat. No. 4,024,643 in which sulfide ores are chlorinated at a temperature which is high enough to cause volatilization of some metal chlorides as well as forming gaseous sulfur chlorides. However, in such a process heat does not have to be added due to the exothermic nature of the reaction, but in order to produce elemental sulfur and to minimize the conversion of impure metals, the temperature must be controlled. The chlorinated product is then leached with water which would quickly turn into a chloride leach system containing all soluble metal chlorides to a high degree. The water in this case is a scrub solution to remove the volatile chlorides and sulfur chlorides from the off-gas stream. This, therefore, is not a wash process but in contradistinction is a leach process in which all metal chlorides which had been substantially converted are leached, leaving behind a residuum of sulfur and only minor amounts of unreacted sulfides. This leach or wash solution acts as the prime metal recovery step whereas, as will hereinafter be shown in greater detail, the wash step of the present invention has, for its primary aim, the removal of a small amount of unwanted metals that had been only slightly converted. Furthermore, due to the high temperature chlorination of the process of the patent it is, of necessity, a non-selective chlorination.

U.S. Pat. No. 1,346,642 describes a separation process for lead and zinc using the differential action of strong hydrochloric acid in an aqueous leach system. In this process, which is a wet chlorination process, the action is effected at a temperature of about 100° C., the hydrochloric acid converting the sulfides, except zinc, to chlorides and the sulfur to gaseous hydrogen sulfide. This treatment is not nearly as selective as the dry halogenation step of the present process, the wet acid treatment producing a greater amount of soluble zinc chloride. Furthermore, the sulfur does not remain as an innocuous solid in this process. The lead chloride and unreacted zinc sulfide are then separated from the solution containing the soluble metal chloride impurities such as iron and copper. A water wash is used to remove the entrained hydrochloric acid leach liquor in the initial leach solids and is combined with the acid leach solution forming the next series of wash. Therefore, this cold water wash actually becomes the leach solution on recycle and, as hereinbefore pointed out, will contain a relatively large amount of impurities. Inasmuch as this wash step is a displacement step to remove all of the free hydrochloric acid, it is not intended to remove the metal impurities per se, but rather to remove the solution which would continue to leach the impurities.

Another patent which is drawn to a method for recovering values from a sulfide ore is U.S. Pat. No. 1,943,340. This patent concerns a two-stage roast of zinc concentrates wherein the first step relates to the sulfation of the concentrate and the second stage relates to a chlorination. Zinc is removed after each roasting stage or step, however, there is no wash step described in this patent. Likewise, U.S. Pat. No. 3,961,941 is drawn to a method of producing metallic lead and silver from the corresponding sulfides. The patent teaches a two-stage ferric leach-brine leach process for lead concentrates and is a wet ferric chloride conversion of lead sulfide to lead chloride. The only wash step which is described in this patent involves the use of said step to wash chloride out of the process tailings before said tailings go to disposal. In contradistinction to the prior art processes, it will be shown in the following specification that metallic lead in a purer sheet form may be produced in a simple and economical manner by a series of steps hereinafter set forth in greater detail.

This invention relates to a hydrometallurgical process for the recovery of lead. More specifically, the invention is concerned with an improved process for obtaining lead from lead sulfide sources or concentrates whereby unwanted side reactions are minimized, thereby insuring that the metallic lead which is recovered in the last stage of the process is in a relatively purer state than has heretofore been possible. As was previously discussed, lead may be recovered in an electrolysis process in which the electrolysis is effected in a molten salt stage. However, the lead which is recovered is in molten form and must be subjected to further treatment such as casting in order to recover the lead in a usable form. Likewise, another disadvantage which is inherent when utilizing an electrowinning process in an aqueous brine medium as set forth in the prior art is that it is necessary to utilize diaphragm cells and the lead which is recovered is in the form of a powder which must thereafter be melted down to ingot form in order to be more easily handled. In contradistinction to this the advantages which are present when utilizing the process of the present invention is that the lead which is obtained is in the form of a sheet on the cathode and is a dense coherent form. In addition another advantage which is found in electrowinning the lead from a hydrofluosilicic acid is that any bismuth which may still be present as an impurity is rejected, thereby permitting the lead to be recovered in a purer state.

It is therefore an object of this invention to provide an improved process for the production of metallic lead.

A further object of this invention is to provide a hydrometallurgical process for the production of relatively pure metallic lead in sheet form using lead sulfide concentrates as the lead bearing source.

In one aspect an embodiment of this invention is found in a process for the production of lead from a lead bearing source which comprises the steps of subjecting said lead bearing source to an activation or drying treatment, halogenating the treated lead bearing source, leaching the halogenated lead bearing source with brine, filtering the leached solution to separate gangue from soluble lead halide, crystallizing said lead halide and recovering metallic lead, the improvement which comprises converting said crystallized lead halide to lead carbonate by treatment with sodium bicarbonate, solubilizing said lead carbonate in hydrofluosilicic acid and subjecting the resulting lead fluosilicate to electrowinning to form metallic lead.

A specific embodiment of this invention is found in a process for the production of lead from a lead bearing source which comprises subjecting said lead bearing source to an activation treatment at a temperature in the range of from about 300° to about 600° C., chlorinating the activated lead bearing source with chlorine gas at a temperature in the range of from about 80° to about 120° C., leaching the chlorinated source at a temperature in the range of from about 80° to about 120° C. with a sodium chloride solution, filtering the leaching solution to separate gaugue and sulfur from soluble lead chloride, crystallizing said lead chloride at a reduced temperature, converting the lead chloride to lead carbonate by treatment with sodium bicarbonate, solubilizing the lead products in hydrofluosilicic acid to form lead fluosilicate and carbon dioxide, subjecting the lead fluosilicate under electrolysis conditions which include a voltage in the range of from about 2.5 to about 4.0 volts and current density in the range of from about 100 to about 400 amps/$m^2$, and recovering the resultant metallic lead.

Other objects and embodiments will be found in the following detailed description of the present invention.

As hereinbefore set forth the present invention is concerned with an improvement in a hydrometallurgical process for the production of metallic lead, whereby said lead is recovered in sheet form. The feedstock which may be utilized in the present process will comprise a lead sulfide source either in the form of flotation concentrates or raw feed ores which are materially rich in lead sulfide, although it is contemplated that some of the lead may be present in the form of lead carbonate or lead oxide. In one embodiment of the invention the lead source may be activated prior to a halogenation step, said activation being accomplished by heating the lead source to a temperature in the range of from about 300° up to about 600° C. or more in an appropriate apparatus such as an oven. The aforesaid roast is preferably effected in an inert atmosphere or a reducing atmosphere; examples of inert atmospheres which may be employed including nitrogen, helium, argon, etc., while the reducing atmosphere may be provided for by the introduction of hydrogen or a mixture of hydrogen and carbon monoxide into the roasting zone. Generally speaking, the lead source is activated by the heat treatment at the aforesaid temperatures for a period of time which may range from about 5 minutes up to about 60 minutes or more. The velocity of the gas which provides the inert or reducing atmosphere may be relatively low in nature and need only be fast enough to purge the volatile materials from the ores as they are formed and sufficient enough to maintain the desired inert or reducing atmosphere, thus preventing any oxidative conditions which may form and which will adversely affect the subsequent halogenation of the lead source.

As an alternative step in the process of this invention, the feedstock may only be subjected to a drying operation in order to remove any water which may be present in said feedstock in order that the material to be processed will remain in a fluid state during the processing operation and will not cake thereby necessitating treatment in the apparatus which is utilized for the process. Another advantage for the drying operation is that the evolution of water will not occur during the subsequent halgenation step to such an extent which is great enough to form significant quantities of hydrogen halide such as hydrogen chloride, hydrogen bromide, etc., or other detrimental products which could effect either the chemical or physical parameters of the process. The drying of the feedstock may be effected at elevated temperatures ranging from about 100° to about 150° C. for a period of time which is sufficient to reduce the water content of the feed to a value of 2% or less.

Following the aforesaid activation of the concentrate or upon completion of the drying of the feedstock and reduction of the water contained, the lead source is then subjected to a halogenation step in which the concentrate is subjected to the action of a halogenating agent such as chlorine gas, fluorine gas, bromine gas, etc., at a temperature of from about 80° to about 120° C. for a period of time which is sufficient to insure conversion of the lead sulfide to the desired lead halide, said halogenating step preferably being effected in a dry atmosphere; the term "dry atmosphere" being defined as an atmosphere wherein the water content of both the atmosphere and the charge stock combined is not greater than about 0.5%. The treatment of the lead sulfide with the halogenating agent is accomplished in such a manner such as by stirring, mixing, shaking, or by any other means known in the art whereby all of the lead sulfide is contacted with the halogenating agent. The resulting mixture of elemental sulfur which has been formed by the chlorination step along with the lead halide such as lead chloride, lead bromide, or lead fluoride is then subjected to a leaching step. This is effected by treating the resulting mixture with a brine solution at an elevated temperature usually in the range of from about 80° to about 120° C., said brine solution usually comprising an aqueous sodium chloride solution containing from about 20 to about 35% by weight of sodium chloride. The leaching of the mixture usually will take place for a period of time which may range from about 0.5 up to about 2 hours or more in duration, the residence time being that which is sufficient to dissolve the aforesaid lead halide.

Upon completion of the leaching step the solution is filtered while maintaining the temperature of the solution at an elevated range of from about 80° to about 120° C. in order to maintain the lead halide in a soluble form. It is also contemplated within the scope of this invention that the separation of the soluble lead halide and the element sulfur which is in solid form may also be effected by a flotation step or by settling whereby, after allowing the solid residue to settle, the liquid is removed by conventional means such as decantation, etc. The solid sulfur and residue which contains gangue, unreacted sulfides of the impurity metals such as zinc sulfide, copper sulfide, silver sulfide, and iron sulfide, may be subjected to a recovery treatment. For example, the elemental sulfur may be recovered by a froth flotation method in which the sulfur is preferentially floated. Likewise, a scrubbing step to more fully liberate sulfur from the rest of the residue may also be effected in the presence of a flotation promoter such as organic compounds readily available including kerosene, etc. The treated material is then transferred to a flotation cell, a frothing agent is added, aeration is initiated, and the sulfur-laden froth is removed from the cell. As an alternative method for the recovery of sulfur, the residue may also be treated with aqueous ammonium sulfide in which the ammonium polysulfide which is formed permits the recovery of elemental sulfur in a crystalline form or, if so desired, the impurities present in the lead sulfide concentrate may also be recovered by conventional means which will include cyanidation of the residue in a leaching operation to recover silver or other precious metals.

The filtrate which contains the soluble lead halide is then passed to a crystallization zone. Inasmuch as temperature is an important factor in the solubility of lead halide, the soluble lead halide source is maintained at elevated temperatures, preferably in a range of from about 100° to about 150° C., until it is passed into the crystallization zone. The crystallization zone is preferably maintained at a temperature somewhat lower than the leach and separation temperatures and preferably in a range of from about 60° C. to ambient temperature (20°-25° C.) or lower, wherein the soluble lead halide will crystallize out due to the temperature drop. If temperatures lower than ambient are required, the lower temperatures may be obtained by the utilization of external cooling means such as an ice bath, cooling coils, other heat exchangers, etc.

The thus crystallized lead halide is recovered from the crystallization zone and separated from the barren leach solution, the latter, if so desired, then being recycled back to the leaching step for further use therein. The separated crystallized lead halide is then passed to a carbonation zone wherein the lead halide is treated with sodium bicarbonate to form lead carbonate. In the preferred embodiment of the invention, the conversion of the lead halide is effected in a chloride system or a water system. The conversion of the lead halide to lead carbonate may be effected at a temperature in the range of from about 5° to about 95° C. for a period of time ranging from about 0.1 up to about 4 hours or more in duration. At the end of this time the lead carbonate which has been formed is then passed from the carbonation zone to a dissolution zone wherein the product is treated with hydrofluosilicic acid to solubilize the lead as lead fluosilicate. The treatment of the lead halide with the sodium carbonate will, as hereinbefore set forth, result in the formation of lead carbonate. The sodium bicarbonate reacts with the lead halide to form the lead carbonate and also results in the formation of sodium halide, hydrogen halide, along with some carbon dioxide from reaction with a part of the hydrogen halide. The first two in aqueous form are passed to a chloride process brine cell, one example being a Hooker type cell in which the solution is subjected to electrical energy whereby halogen gas is produced and recycled to the halogenation zone, the sodium hydroxide which is formed in the brine cell is passed to a formation zone wherein it is contacted with the carbon dioxide from the dissolution and conversion zones to form sodium bicarbonate which is then recycled back to the conversion zone. The treatment of the lead carbonate with aqueous hydrofluosilicic acid, in which the hydrofluosilicic acid is present in an amount in the range of from about 5 to about 30% by weight is effected at a temperature in the range of from about 10° to about 100° C. After completion of the formation of lead fluosilicate it is then passed into an electrowinning cell wherein the solution is subjected to an electrowinning reaction utilizing standard anodes and cathodes consisting of graphite, titanium, platinum, etc. The electrowinning of the lead fluosilicate is effected under electrolysis conditions in which the parameters which are employed will include voltages within the range of from about 2.5 to about 4.0 volts and current densities in the range of from about 100 to about 400 amps/$m^2$. The electrowinning of the lead fluosilicate will result in the obtention of metallic lead in the form of sheets on the cathodes, said sheets being dense and coherent in nature. The hydrofluosilicic acid which is formed during the electrolysis reaction may then be recycled back to the dissolution zone for use therein as the dissolution agent.

BRIEF DESCRIPTION OF THE DRAWING

The present drawing will be further illustrated with reference to the accompanying drawing which illustrates a simplified flow diagram of the present process. Various valves, coolers, condensers, pumps, controllers, etc., have been eliminated as not being essential to the complete understanding of the present invention. The illustration of these, as well as other essential appurtenances, will become obvious as the drawing is described.

Referring now to the drawing, a charge stock of lead containing concentrates such as that derived from galena ores, etc., is passed through line 1 to halogenation zone 2, the charge stock having previously been either activated by heating to a temperature in the range of from about 300° to about 600° C. or dried at a temperature in the range of from about 100° to about 150° C. in an apparatus which is not shown in the drawing. In halogenation zone 2 the lead source is contacted with a halogenating agent such as chlorine gas, fluorine gas, bromine gas, etc., which is charged through line 3 to halogenation zone 2. As will hereinafter be described, the halogenating agent is recycled from a further step in the process, any start-up or make-up gas being passed into line 3 through line 4. The halogenation of the lead source to form the corresponding lead halide is effected at a temperature in the range of from about 80° to about 120° C. in a dry atmosphere. In halogenation zone 2 the treatment of the lead source with the halogenating agent is accomplished in such a manner such as by stirring, mixing, shaking, fluidization, etc., whereby all of the lead source such as a lead sulfide is contacted with the halogenating agent. The resulting mixture of elemental sulfur and lead halide is then passed through line 5 to a water wash zone, not shown in the drawing, wherein it is contacted with an influx of water with the result that minor amounts of chlorinated impurities such as soluble metal halides including compounds such as ferric chloride, copper chloride, zinc chloride, cadmium chloride, etc., are separated from the solid lead halide and removed. After removal of such impurities the solids, comprising elemental sulfur, lead halide and unreacted impurity sulfides are passed to brine leach zone 6. In brine leach zone 6 the solid product is treated with an aqueous brine solution containing from about 20% to about 35% by weight of sodium chloride. The leaching of the mixture is also effected at elevated temperatures in the range of from about 80° to about 120° C. In the preferred embodiment of the invention, the pH of the brine leaching solution is maintained in a range of from about 2 to about 8 during the leaching step by the addition of a caustic solution such as sodium hydroxide, potassium hydroxide, etc., or a hydrohalide acid such as hydrochloric acid, as required, through line 7. Upon completion of the leaching step, the mixture is passed through line 8 to separation zone 9 wherein the soluble lead halide solution which has resulted from the brine leach step of the process is separated from elemental sulfur as well as any solid gangue impurities, the solids being removed from separation zone 9 through line 10. The separation of the soluble lead halide solution and the solid sulfur or gangue may be effected by filtration, or by flotation and settling whereby, after allowing the solid residue containing the elemental sulfur and/or impurities to settle, the liquid is removed by conventional means such as decantation, filtration, etc.

The soluble lead halide solution such as lead chloride is recovered from separation zone 9 through line 11 and passed to crystallization zone 12. Inasmuch as temperature is an important factor in the solubility of lead halides, the soluble lead halide solution is maintained at an elevated temperature, preferably in a range of from about 100° to about 105° C. prior to passage into crystallization zone 12. The crystallization zone is maintained at a temperature lower than that of the leach and separation zones, and preferably lower than about 60° C. Upon cooling the lead halide will precipitate out as crystals and after crystallization of the lead halide the barren leach liquor is removed from crystallization zone 12 through line 13 for heating and recycle back through line 13 to brine leach zone 6 for further use therein. The solid lead halide crystals are withdrawn from crystallization zone 12 through line 14 and passed to conversion zone 15 wherein the crystals are treated with sodium bicarbonate. The conversion of lead halide to lead carbonate is preferably effected in an aqueous system or a clean brine solution which acts as a neutral chloride system. The solium bicarbonate is charged to carbonate zone 15 through line 16 and if an additional amount of sodium bicarbonate is required as make-up or in the start-up, it is charged to line 16 through line 17 and thence into conversion zone 15. The conversion of the lead halide such as lead chloride to lead carbonate will result in the formation of various components of the system such as hydrogen chloride, sodium chloride, and some carbon dioxide, the carbon dioxide coming from some reaction with the HCl. The aqueous sodium chloride and hydrogen chloride solution is withdrawn from carbonation zone 15 through line 18 and passed to brine cell 19 which may comprise a Hooker type cell. In brine cell 19 the aqueous mixture is subjected to an electrical energy which may range from about 3 to about 4 volts and a current efficiency of from 94 to 96% whereby the compounds are converted into chlorine gas which is withdrawn from brine cell 19 through line 3 for recycle back to halogenation zone 2 while the sodium hydroxide which has been formed in the brine cell is withdrawn from the cell through line 20 for passage into formation zone 21. In formation zone 21 sodium hydroxide is contacted with the carbon dioxide which has been withdrawn from conversion zone 15 through line 22 to form sodium bicarbonate and from the dissolution zone 24 through line 27. The sodium bicarbonate which is formed in zone 21 is withdrawn from the zone through line 16 for recycle back to conversion or carbonation zone 15 wherein it is used to treat the lead halide.

After formation of the lead carbonate in carbonation zone 15, the products are withdrawn through line 23 and passed to dissolution zone 24 wherein the lead carbonate is contacted with hydrofluosilicic acid. After formation of lead fluosilicate in dissolution zone 24, the compound is withdrawn from the zone through line 25 and passed to electrolysis zone 26, said zone comprising a conventional electrolysis or electrorefining cell. The carbon dioxide which is formed in dissolution zone 24 is withdrawn from the zone through line 27 and recycled back to formation zone 21 as previously described. In electrolysis zone 26 the lead fluosilicate is subjected to an electrowinning process whereby metallic lead is formed on the cathode as dense and coherent sheets. The hydrofluosilicic acid which is regenerated during the electrolysis process is withdrawn from electrolysis zone 26 through line 28 for recycle to dissolution zone 24. The start-up fluosilicic acid or any make-up fluosilicic acid which is required may, if so desired, be added to line 28 through line 29.

While the above discussion has been descriptive of a continuous method of operating the process of the present invention, it is also contemplated that the recovery of metallic lead or a lead source such as a lead sulfide ore or concentrate may also be effected in a batch type operation. When this type of operation is used a quantity of the charge stock is activated by treatment with a temperature in the range hereinbefore set forth or is dried by placing it in a dry apparatus such as an oven and subjecting the charge to a drying step at a temperature within the range hereinbefore set forth. Upon completion of the present halogenation treatment the charge stock is then placed in an appropriate apparatus wherein it is subjected to the action of a halogenating agent. Inasmuch as the halogenation of the lead sulfide is exothermic in nature, the heat of reaction which is evolved will be controlled within the desired operating range of from 80° to 120° C. Upon completion of the conversion of the lead sulfide to the desired halide the halogenated product is then water washed to dissolve any soluble metal halide compounds other than lead which may be present as impurities in the charge stock. The water wash solid product is separated from the wash by conventional means such as filtration, decantation, etc., and subjected to the action of a brine leaching solution in another apparatus whereby the lead halide is solubilized. After agitating or thoroughly admixing the solution for a predetermined period of time which is sufficient to dissolve the lead halide while maintaining the pH of the solution in a range of from 2 to about 8 by the addition of a controlled amount of caustic solution or acid, said brine leaching step being effected at an elevated temperature in the range of from about 80° to about 120° C., the soluble lead halide is separated from elemental sulfur and gangue and thereafter recovered by conventional means. By allowing the solution to cool to a lower temperature, preferably below about 60° C., the brine solution is separated from the solid lead halide crystals and removed.

The recovered lead halide crystals are then placed in an apparatus and subjected to the action of sodium bicarbonate whereby the lead halide is converted to lead carbonate. The latter compound is separated and transferred to a dissolution apparatus such as a flask, vat, etc., and treated with hydrofluosilicic acid to dissolve the lead carbonate and form lead fluosilicate. Following this the solution of lead fluosilicate is placed in an electrolytic cell which contains electrodes such as graphite, titanium, platinum, etc., and subjected to an electrowinning process whereby the lead is recovered as a dense, coherent sheet on the cathode.

The following examples are given merely for purposes of illustrating the process of the present invention. However, it is to be understood that these examples are merely illustrative and are not intended to limit the generally broad scope of the invention in strict accordance therewith.

EXAMPLE I

A lead sulfide feed was placed in an oven which was thereafter heated to a temperature of 110° C. for a period of 3 hours. After this, the feed was then placed in a flask provided with rotation means, gas inlet means and heating means which comprises an adjustable heat lamp. The rotation means were provided in order that a constant reactor rotation for the agitation of the feed might be maintained while the heat lamp could be adjusted to provide a constant reactor temperature. Chlorine gas was then charged to the reactor on a demand basis which was dictated by the chlorination reaction. The temperature of the reactor was maintained in a range of from about 90° to about 95° C. while controlling the input of chlorine gas as well as by providing heat from the aforementioned external heat lamp source. The reaction was allowed to proceed for a period of about 3 hours following which the concentrate was water washed with 400 cc of water at ambient temperature. The water which contained dissolved metal halide impurities was separated from the solid reaction mixture and the latter was placed in a brine solution which contained 25% sodium chloride. The leach of the product was effected at a temperature of 100° C. while maintaining the pH of the solution at 6. After agitating the slurry for a period of 0.5 hours the slurry was filtered while maintaining the temperature of the solution at 100° C. The filtrate which contained the soluble lead chloride was passed to a crystallizer which was maintained at room temperature, the temperature drop in the crystallizer allowing the lead chloride to reprecipitate as lead chloride crystals.

A solution made up of 50 grams of lead chloride was then treated with sodium bicarbonate at a temperature of 25° C. for a period of 1 hour. In the first experiment 3.78 grams of sodium bicarbonate which was the amount necessary to effect a theoretical conversion of 25% of the lead chloride based on the reaction: $PbCl_2+Na_2CO_3 \rightarrow PbCO_3+2NaCl$ was used. At the end of the 1 hour period analyses determined that there had been an actual conversion of 28.2% of the lead chloride with 91.5% of the amount of chloride present in the solid and liquid accounted for. The lead carbonate which was precipitated out of the solution was recovered by filtration and added to 600 cc of hydrofluosilicic acid at ambient temperature. The lead carbonate dissolved in the acid forming lead fluosilicate which was subjected to electrowinning in a conventional electrolysis cell using graphite anode and cathode. The electrowinning was performed using a voltage of 3.6 volts and a current density of 388 amps/m$^2$, the lead being recovered in the form of sheets on the cathode.

EXAMPLE II

In this example 50 grams of lead chloride which was obtained in a manner similar to that set forth in Example I above was treated with 7.56 grams of sodium bicarbonate, the amount calculated to effect a 50% theoretical conversion to the lead carbonate. The reaction was effected at a temperature turn of 25° C. for 1 hour, the natural pH of the solution being 5.85. Analyses at the end of this 1 hour period determined that there had been a 45.0% actual conversion of the lead chloride with 91.3% of the amount of chloride present in the solid and liquid accounted for.

A repeat of the experiment set forth in the above paragraph using 15.12 grams of sodium bicarbonate which was the amount required for a 100% theoretical conversion of 50 grams of lead chloride resulted in an actual conversion of 94.8% of the lead chloride to lead carbonate with a material balance of 102.6% of the amount of chloride present in the solid and liquid accounted for. The lead carbonate which was obtained from these two experiments was treated with hydrofluosilicic acid to form lead fluosilicate which was thereafter subjected to an aqueous electrowinning process. The electrowinning, which was performed in a conventional electrolysis cell using a graphite anode and cathode resulted in obtaining metallic lead in the form of sheets on the cathode.

I claim as my invention:

1. In a process for the production of lead from a lead bearing source which comprises the steps of:

(a) subjecting said lead bearing source to an activation or drying treatment;
(b) halogenating the treated lead bearing source;
(c) leaching the halogenated lead bearing source with brine;
(d) filtering the leached solution to separate gangue from soluble lead halide;
(e) crystallizing said lead halide; and
(f) recovering metallic lead, the improvement which comprises converting said crystallized lead halide to lead carbonate by treatment with sodium bicarbonate, solubilizing said lead carbonate in hydrofluosilicic acid and subjecting the resulting lead fluosilicate to electrowinning to form metallic lead.

2. The process as set forth in claim 1 in which said activation treatment is effected at a temperature in the range of from about 300° to about 600° C. in a neutral or reducing atmosphere.

3. The process as set forth in claim 1 in which said drying is effected at a temperature in the range of from about 100° to about 150° C.

4. The process as set forth in claim 1 in which said halogenation of said lead bearing source is effected by treating said source with a gaseous halogenating agent.

5. The process as set forth in claim 4 in which said gaseous halogenating agent is chlorine gas.

6. The process as set forth in claim 4 in which said halogenation is effected at a temperature in the range of from about 80° to about 120° C.

7. The process as set forth in claim 1 in which said halogenated lead bearing source is leached at a temperature in the range of from about 80° to about 120° C. with a sodium chloride solution.

8. The process as set forth in claim 1 in which the conversion of lead halide to lead carbonate is effected in a neutral chloride or water system using sodium bicarbonate as the conversion agent.

9. The process as set forth in claim 1 in which the electrowinning is effected under electrolysis conditions which include a voltage in the range of from about 2.5 to about 4.0 volts and a current density in the range of from about 100 to about 400 amps/$m^2$.

* * * * *